US005794718A

United States Patent [19]

Zollinger et al.

[11] Patent Number: 5,794,718

[45] Date of Patent: Aug. 18, 1998

[54] MANEUVERING IMPACT BORING HEAD

[75] Inventors: W. Thor Zollinger; Edward W. Reutzel, both of Idaho Falls, Id.

[73] Assignee: Lockheed Idaho Technologies Company, Idaho Falls, Id.

[21] Appl. No.: 613,301

[22] Filed: Mar. 11, 1996

[51] Int. Cl.[6] ..... E21B 4/14

[52] U.S. Cl. ..... 175/19; 173/91; 175/73; 175/296

[58] Field of Search ..... 175/19, 92, 296, 175/73; 173/204, 208, 211, 212, 91

[56] References Cited

U.S. PATENT DOCUMENTS

| | | | |
|---|---|---|---|
| 3,032,998 | 5/1962 | Atkinson | 173/212 X |
| 3,630,295 | 12/1971 | Coyne et al. | 175/73 |
| 3,794,128 | 2/1974 | Gagen et al. | 175/73 |
| 4,078,619 | 3/1978 | Sudnishnikow et al. | 175/19 |
| 4,592,432 | 6/1986 | Williams et al. | 175/73 X |
| 4,596,292 | 6/1986 | Crover | 175/19 |
| 4,621,698 | 11/1986 | Pittard et al. | 175/19 X |
| 5,255,749 | 10/1993 | Bumpurs et al. | 175/26 |
| 5,553,764 | 9/1996 | Remerowski | 173/212 X |

OTHER PUBLICATIONS

Sales brochure of the Charles Machine Works, Inc. for the Ditch Witch Pierce Airrow Pneumatic Piercing Tool.

Sales brochure fof Steer-Rite, Ltd. for the Pathfinder, Patriot 2000, Essig, and IH300 Boring Tools.

Sales brochure of Allied Company for various Hole-Hog Underground Boring Tools.

*Primary Examiner*—Hoang C. Dang

*Attorney, Agent, or Firm*—Klaas Law O'Meara & Malkin; Alan D. Kirsch

[57] ABSTRACT

An impact boring head may comprise a main body having an internal cavity with a front end and a rear end. A striker having a head end and a tail end is slidably mounted in the internal cavity of the main body so that the striker can be reciprocated between a forward position and an aft position in response to hydraulic pressure. A compressible gas contained in the internal cavity between the head end of the striker and the front end of the internal cavity returns the striker to the aft position upon removal of the hydraulic pressure.

22 Claims, 6 Drawing Sheets

MANEUVERING IMPACT BORING HEAD

CONTRACTUAL ORIGIN OF THE INVENTION

The United States Government has rights in this invention disclosed under contract number DE-AC07-84ID12435 between the U.S. Department of Energy and Westinghouse Idaho Nuclear Company, now contract number DE-AC07-94ID13223 with Lockheed Idaho Technologies Company.

FIELD OF THE INVENTION

This invention relates to underground boring devices in general and more specifically to maneuvering impact boring heads.

BACKGROUND OF THE INVENTION

Underground boring heads are used to bore relatively small tunnels underground and for considerable distances. Consequently, they may be used to install underground cables, piping, and other like apparatus that are normally installed by pipe or cable pullers, or by burying them in trenches.

Underground boring heads suitable for such uses are typically of the impact type. Briefly, an impact type boring head comprises an internal hammer or striker that is reciprocated back and forth within the boring head itself. When the internal hammer or striker impacts the internal front end of the boring head during the forward stroke, a substantial portion of the forward momentum of the striker is transferred to the boring head. It is this forward momentum that advances the boring head through the ground. Thus, the operation of an impact boring head is akin to driving a nail with a hammer, except that the hammer is replaced by the internal striker.

In order to increase utility, many impact boring heads are also maneuverable or steerable so that they can be advanced in the proper directions and maneuvered around underground obstacles. One type of maneuvering impact boring head includes a slanted or beveled nose section and a rotatable tail section having spiraled fins. The slant or bevel on the nose section causes a side force to be exerted on the boring head as it moves through the ground. The spiraled fins on the tail section cause it to rotate about its longitudinal axis (i.e., long axis) as it moves through the ground. The tail section may also be rotatably locked and unlocked with respect to the nose section.

Such a maneuvering boring head can be made to travel in a straight line by locking the tail section with respect to the nose section. So configured, the spiraled fins on the tail section cause the entire boring head to rotate about its longitudinal axis. While the side or turning force is still exerted on the beveled nose section, the net turning force over time is essentially zero since the nose section is rotating about its longitudinal axis. That is, the turning force vector also rotates about the longitudinal axis. Conversely, the boring head may be turned by unlocking the tail section with respect to the nose section. In this configuration, the tail section continues to spin or rotate about its longitudinal axis while the non-spinning nose section will begin to turn in a direction opposite the direction of the bevel on the nose.

Impact boring heads of the type described above may be hydraulically or pneumatically powered. If the boring head is hydraulically powered, the motive power used to reciprocate the striker within the boring head and to activate the steering mechanism (e.g., to lock and unlock the tail section) may be provided by a supply of a pressurized, incompressible fluid, such as oil. If the boring head is pneumatically powered, then the motive power may be derived from a supply of a pressurized compressible fluid, such as air. In either case, the pressurized fluid (e.g., oil or air) is typically provided to the boring head via a flexible hose.

Both hydraulic and pneumatic impact boring heads typically include a plurality of valves mounted within the boring head itself to selectively direct the flow of pressurized fluid (e.g., oil or air) to opposite sides of the striker. By properly sequencing the operation of the valves, the striker can be made to reciprocate within the boring head. If the boring head is also of the maneuvering type, other sets of valves contained within the boring head may be used to activate the steering mechanism (e.g., to lock and unlock the tail section with respect to the nose section in the manner already described).

While impact boring heads of the type described above are well-known and are being used, they are not without their disadvantages. For example, the internal valve arrangements used to reciprocate the striker within the head and to provide the steering function can add significantly to the overall mass and length of the boring head. Unfortunately, the increased mass results in a proportional loss in boring efficiency while the increased length reduces the maneuverability of the boring head. Another disadvantage associated with such an internal valve assembly is that it adds complexity, thus cost, to the boring head. Further, if the valve assembly malfunctions during the boring operation, the entire boring head must be removed from the tunnel and disassembled before the malfunctioning valve assembly can be repaired.

Yet another disadvantage associated with the maneuvering impact boring heads of the type described above is that they typically have large turning radii, usually in the range of 50 to 90 feet. Quite obviously, such large turning radii are not always sufficient to allow the boring heads to be maneuvered around underground obstacles, or even to be maneuvered in the desired direction.

Consequently, the need exists for an impact boring head having increased boring efficiency and maneuverability. Additional utility could be realized if the valve arrangement used to reciprocate the internal striker and maneuver the boring head could be serviced without the need to remove the boring head from the tunnel and without the need to disassemble the boring head itself.

SUMMARY OF THE INVENTION

An impact boring head according to the present invention may comprise a main body having an internal cavity with a front end and a rear end. A striker having a head end and a tail end is slidably mounted in the internal cavity of the main body so that the striker can be reciprocated between a forward position and an aft position in response to hydraulic pressure. A compressible gas contained in the internal cavity between the head end of the striker and the front end of the internal cavity returns the striker to the aft position upon removal of the hydraulic pressure.

Another embodiment of the impact boring head may include a fixed guide vane mounted to the main body and a moveable guide vane mounted to the main body at a position aft of and substantially in line with the fixed guide vane. A guide vane actuator connected to the moveable guide vane pivots the moveable guide vane about an axis transverse to the longitudinal axis of the main body to apply a side force to the impact boring head.

An impact boring head system according to the present invention may comprise a main body having an internal cavity with a front end and a rear end. A striker having a head end and a tail end is slidably mounted in the internal cavity of the main body so that the striker can be reciprocated between a forward position and an aft position. A compressible gas is contained in the internal cavity between the head end of the striker and the front end of the internal cavity. A pressurized fluid delivery system is fluidically connected to the main body and introduces a fluid under pressure to the rear end of the internal cavity of the main body. The fluid under pressure acts against the tail end of the striker to drive the striker to the forward position. As the striker moves to the forward position it also pressurizes the compressible gas. The pressurized compressed gas returns the striker to the aft position when the pressurized fluid is removed from the tail end of the striker.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
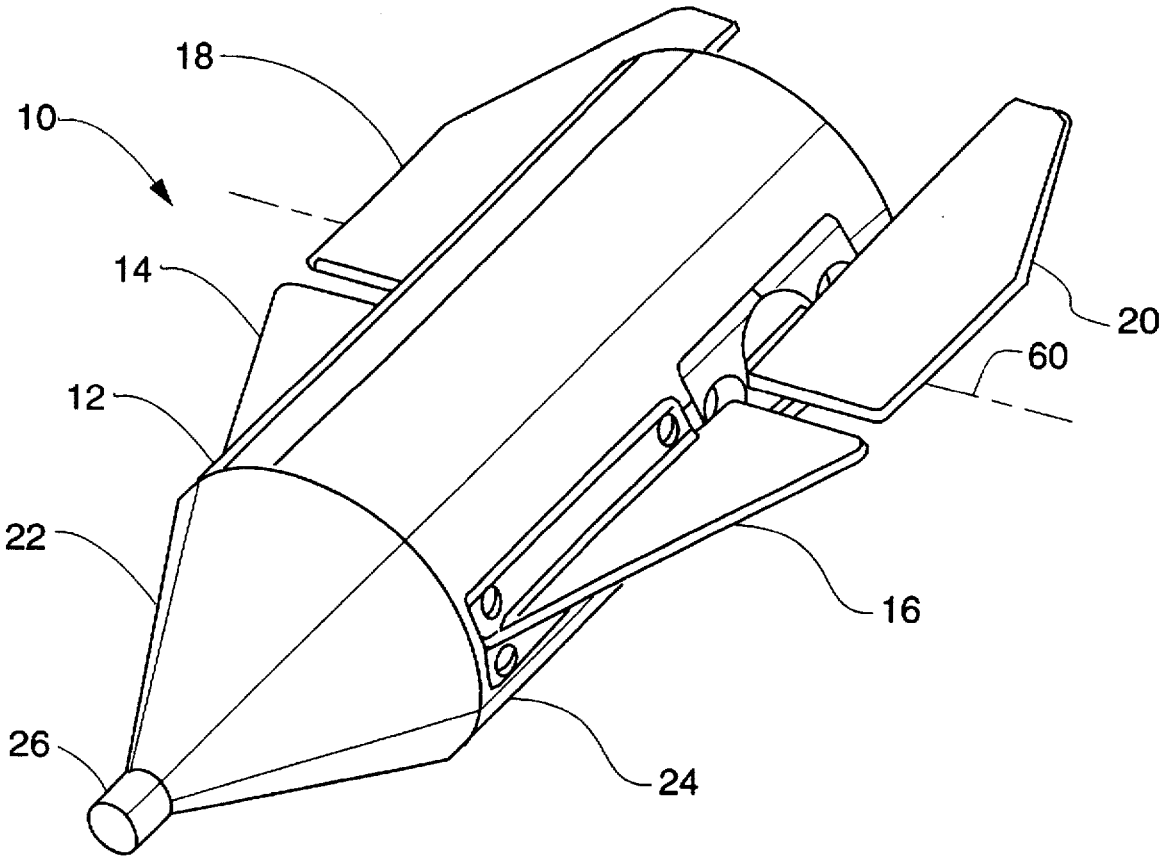
FIG. 1 is a perspective view of a maneuvering impact boring head according to the present invention.
Figure 2:
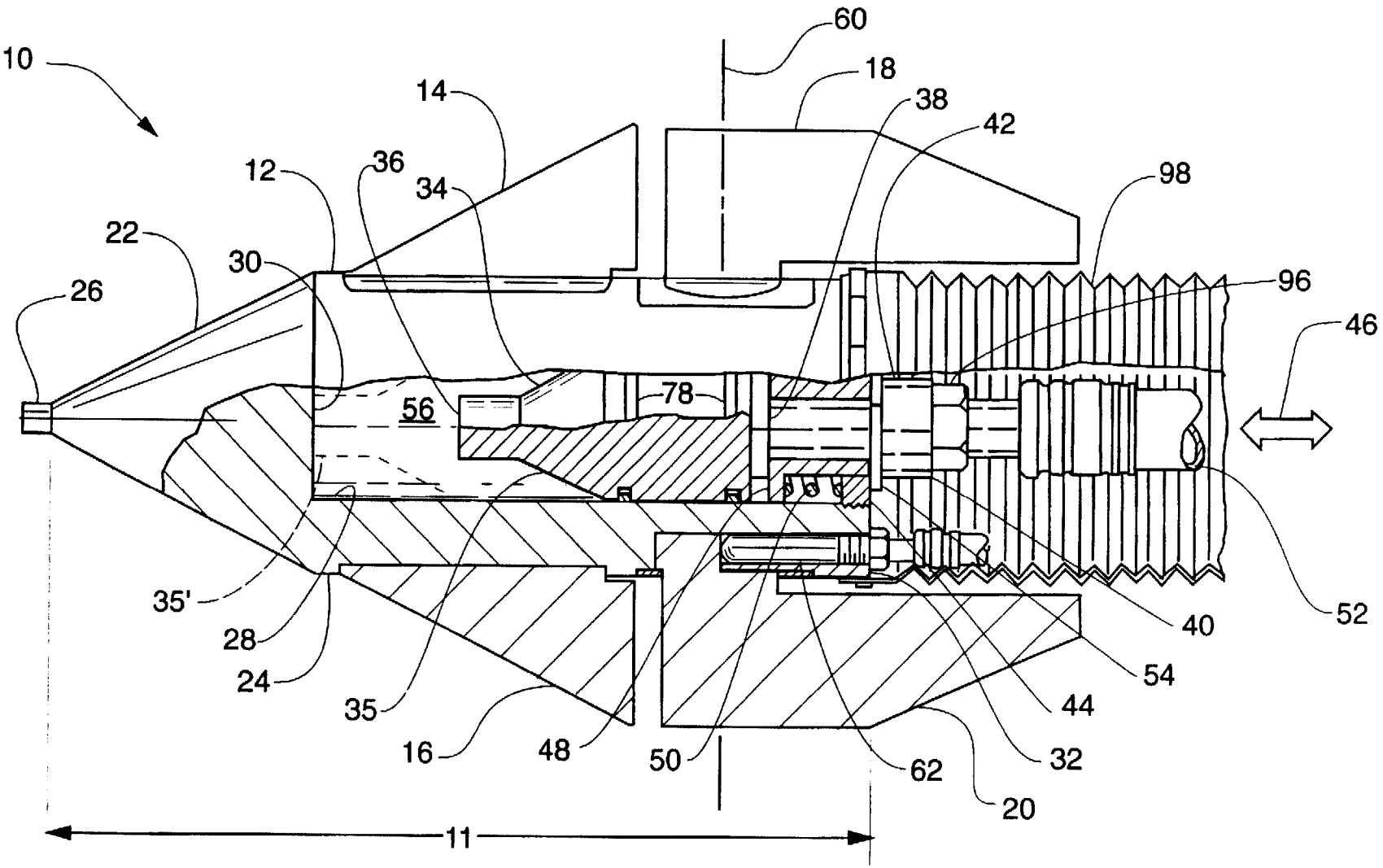
FIG. 2 is a cross-section view of the maneuvering impact boring head showing the details of the striker, vane actuator, and surge absorber.

A maneuvering impact boring head 10 according to the present invention is best seen in FIGS. 1 and 2 and may comprise a main body 12 having a conical nose section 22 and a cylindrical body section 24. A pair of fixed guide vanes 14 and 16 may be attached to the cylindrical body section 24 at substantially diametrically opposed positions. Similarly, a pair of moveable guide vanes 18 and 20 may be attached to the cylindrical body 24 at positions immediately aft of and in line with the fixed guide vanes 14 and 16, respectively. In one preferred embodiment, the conical nose section 22 of main body 12 may also include a replaceable tip 26.

Referring now to FIG. 2, the main body 12 may also include an internal cylindrical bore or cavity 28 having a front end 30 and a rear end 32. A striker 34 having a head end 36 and a tail end 38 is positioned in the internal cavity 28 so that it can be reciprocated between an aft position 35 (shown in solid lines) and a forward position 35' (shown in broken lines). The fit between the striker 34 and the internal cavity 28 is substantially gas tight. A chamber 56 defined between the front end 30 of internal cavity 28 and the striker 34 contains a quantity of a nonreactive compressible gas, such as nitrogen (not shown).

A surge absorber assembly 40 mounted to the rear end 32 of the internal cavity 28 absorbs contractions in the hose 52 caused by its pressurization. Essentially, surge absorber assembly 40 comprises an elongate tubular coupling 42 that is slidably retained by an end cap 44 secured to main body 12. A spring 50 positioned between the end cap 44 and a shoulder 48 on the coupling 42 biases the coupling 42 toward the front end 30 of internal cavity 28.

Figure 5:
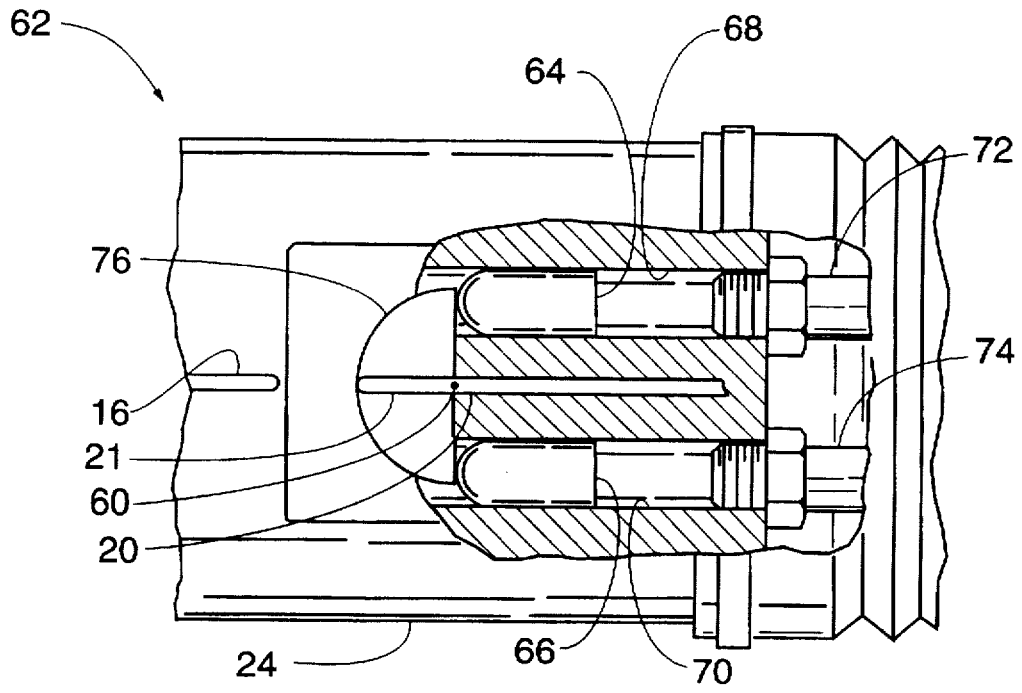
FIG. 5 is an enlarged cross-section view of a vane actuator with the guide vane in a neutral position.
Figure 6:
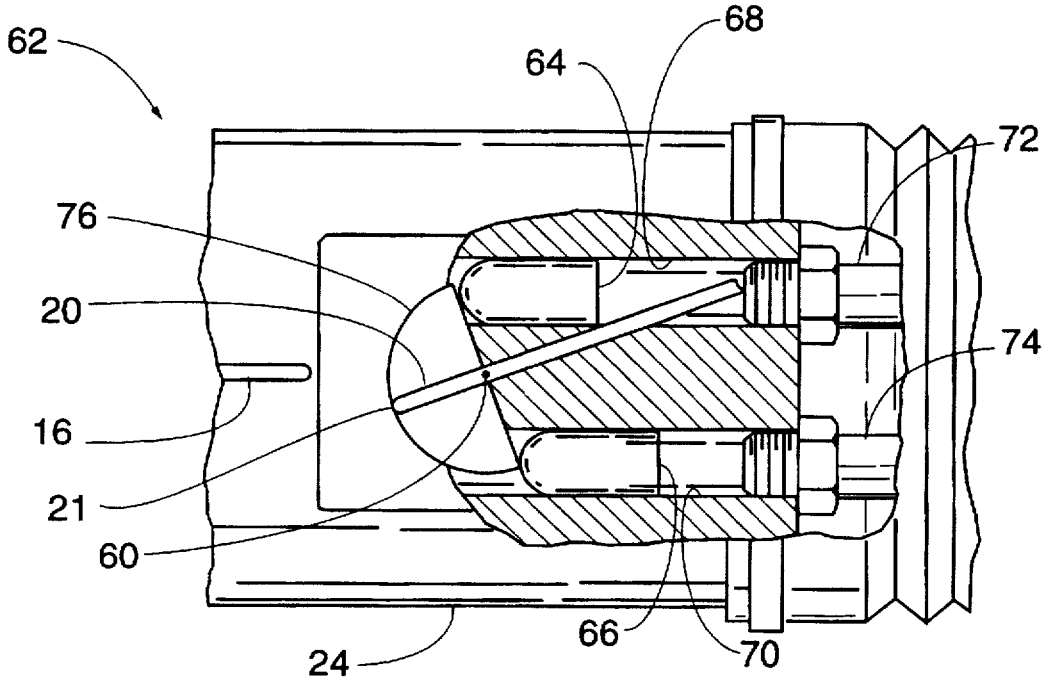
FIG. 6 is an enlarged cross-section view of the vane actuator of FIG. 5 showing the guide vane in a deflected position.

The guide vanes 14, 16, 18, and 20 stabilize the boring head 10 and allow it to be maneuvered underground. The forward guide vanes 14 and 16 are fixed, while aft guide vanes 18 and 20 may be pivoted about axis 60. In one preferred embodiment, each moveable guide vane 18, 20 may be independently deflected or pivoted about axis 60 by a guide vane actuator assembly, such as guide vane actuator assembly 62, as best seen in FIGS. 5 and 6.

Figure 7:
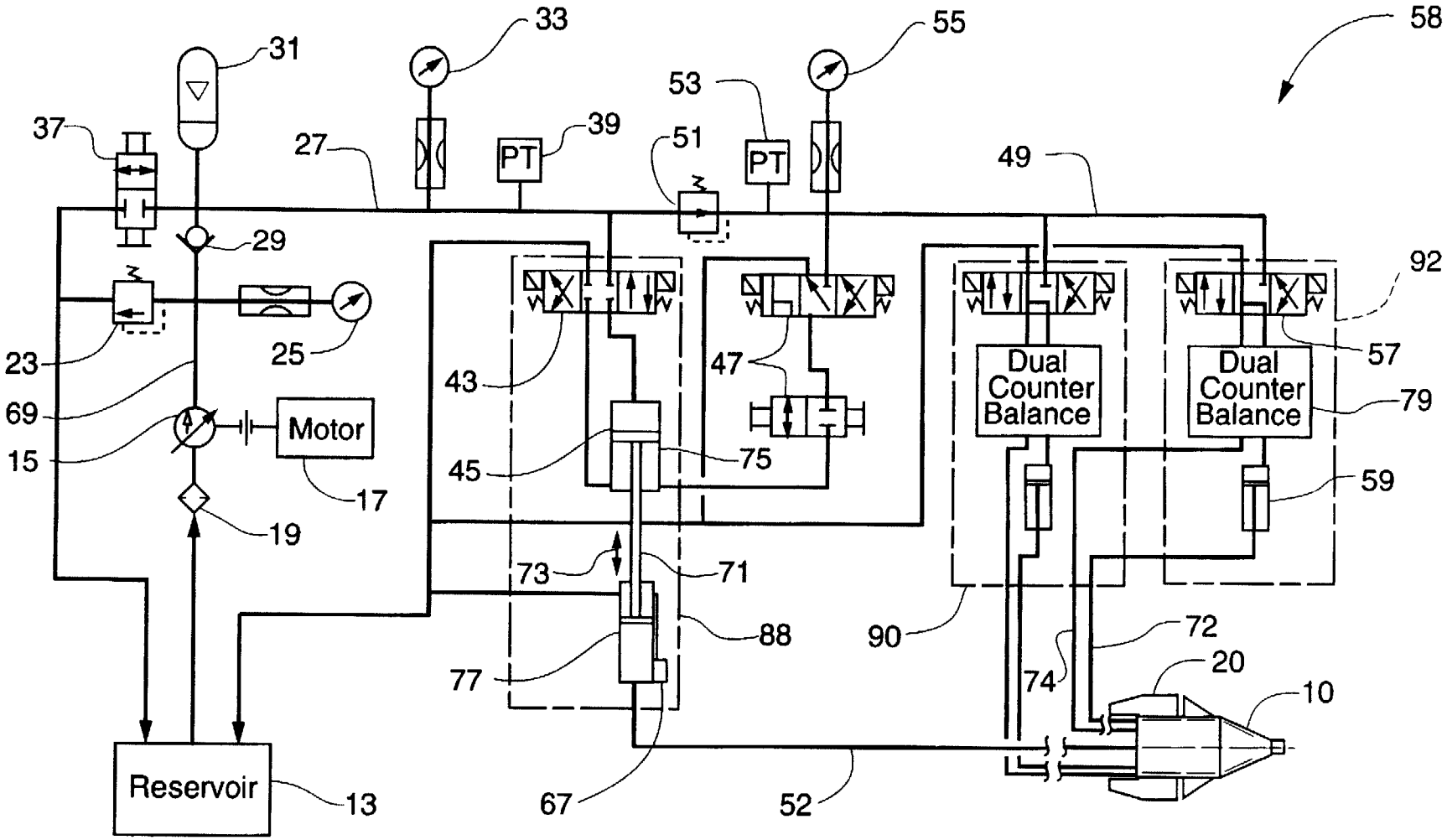
FIG. 7 is a schematic of the hydraulic control system and valve assembly used to reciprocate the striker and control the fin actuators.

Referring now to FIG. 7, the maneuvering impact boring head 10 may be controlled by a hydraulic system 58. As will be described in greater detail below, hydraulic system 58 contains a striker valve assembly 88 and two guide vane valve assemblies 90 and 92. The striker valve assembly 88 controls the flow of pressurized hydraulic fluid to the striker 34, causing it to reciprocate in the internal bore or cavity 28. The two guide vane valve assemblies 90 and 92 control the guide vane actuators, such as guide vane actuator 62, to deflect the moveable guide vanes 18 and 20.

Figure 8:
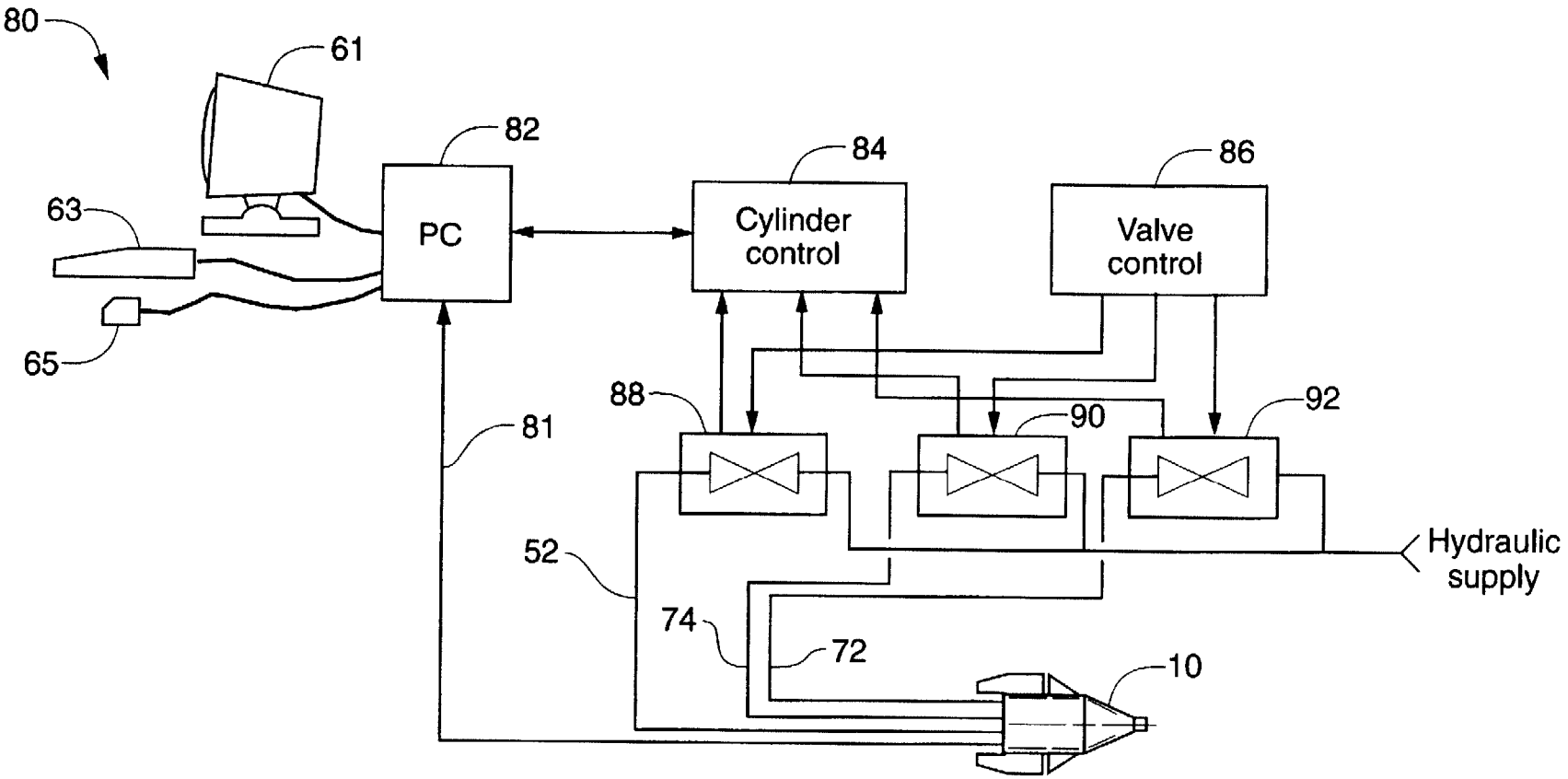
FIG. 8 is a block diagram of a computer control system for operating the hydraulic control system shown in FIG. 7.

In one preferred embodiment, the hydraulic system 58 may be controlled by a PC-based computer control system 80, as best seen in FIG. 8. Briefly, the computer system 80 may comprise a central processing unit, such as a personal computer (PC) 82, a cylinder control module 84, and a valve control module 86. The cylinder control module 84 receives signals from the PC 82 and sends appropriate valve actuation signals to the valve control module 86. Valve control module 86 directly controls the operation of the various hydraulic valves of the hydraulic system 58 (FIG. 7), such as striker valve assembly 88 and the two guide vane valve assemblies 90 and 92.

The maneuvering impact boring head 10 may be operated as follows. The computer system 80 may be monitored and controlled by a user (not shown) to initialize the boring sequence and provide guidance instructions to the boring head so that it will follow substantially a predetermined path. The computer system 80 then operates the hydraulic system 58 to reciprocate the striker 34 and actuate the moveable guide vanes 18 and 20 as necessary to cause the boring head 10 to begin the boring sequence and follow the desired path. The striker 34 is reciprocated by striker valve assembly 88 which alternately connects and disconnects the hose 52 to a supply of pressurized hydraulic fluid. The pressurized hydraulic fluid acts against the tail end 38 of striker 34 causing it to move forward in the internal cavity 28 at a high velocity. When the striker 34 impacts the front end 30 of cavity 28, a substantial portion of the forward momentum of the striker 34 is transferred to the main body 12, causing it to advance into the ground. As the striker 34 moves to the forward position 35' (FIG. 2) it also compresses the gas (not shown) contained within chamber 56. After the striker 34 has impacted the front end 30 of cavity 28, valve assembly 88 removes the hydraulic pressure and the compressed gas (not shown) contained in chamber 56 forces the striker 34 to return to its aft or starting position 35 (FIG. 2). The hose 52 is then re-pressurized to repeat the impact cycle.

Figure 4:
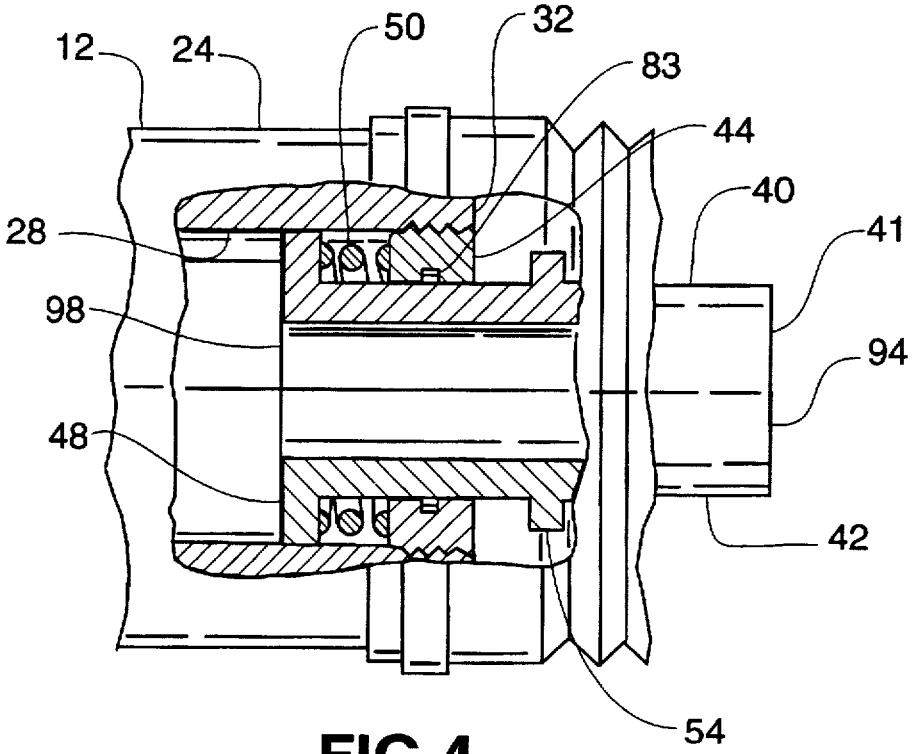
FIG. 4 is an enlarged cross-section view of the surge absorber in the compressed position.

When the hydraulic system 58 is actuated to drive the striker 34 to the forward position 35', the rapid pressure increase in the flexible hose 52 tends to cause it to grow slightly larger in diameter and to contract slightly. In many cases, the contraction of the hose 52 would be sufficient to draw back the boring head 10 from the face of the tunnel bore. Were that to happen, most of the forward momentum from the striker 34 would be spent re-advancing the boring head to the face of the tunnel bore and very little of the forward momentum would remain available to advance the boring head 10 into the ground. The surge absorber 40 mounted to the rear end 32 of body 12 prevents the contracting hose 52 from drawing back the boring head 10 by moving in the rearward direction against the spring 50 (FIG. 4). Consequently, nearly all of the forward momentum from the striker blows can be used to advance the boring head 10 into the ground. Finally, as the boring head 10 moves through the ground, the moveable guide vanes 18 and 20 are actuated as necessary by guide vane valve assemblies 90 and 92 to maneuver the boring head 10 in the desired direction and around underground obstacles.

A significant advantage of the maneuvering impact boring head 10 according to the present invention is that the valve assembly required to reciprocate the striker 34 within the internal cavity 28 of body 12 is not contained within the boring head 10, but rather is located at a remote position from the boring head 10, preferably above ground. The remote location of the valve body allows the boring head 10 to be considerably shorter and less massive, which increases both maneuverability and boring efficiency. It also greatly simplifies the construction of the boring head. The location of the valve assembly above ground also allows for convenient repair of the valve assembly should it malfunction during the boring operation.

Another advantage is that the compressible gas (e.g., nitrogen) used to return the striker 34 to the aft or starting position 35 eliminates the need to expose the head end 36 of striker 34 to pressurized hydraulic fluid. Consequently, the structure of the main body 12 is simplified in that separate passages and/or valve assemblies are not required to direct hydraulic fluid to the head end 36 of the striker 34 to return it to the aft position 35.

Still other advantages are associated with the surge absorber 40. For example, the surge absorber 40 prevents the boring head 10 from being pulled away from the face of the tunnel being bored by absorbing contractions of the hose 52 that occur when it is pressurized. Thus, more of the forward momentum from the striker can be used to advance the boring head into the ground.

The arrangement of the fixed and moveable guide vanes 14, 16, 18, and 20 and the short length of the boring head 10 allows it to be maneuvered in very short radius turns, typically in the range of a few feet. Also, since the valve assembly required to actuate the moveable guide vanes 18 and 20 is remotely located from the boring head, the boring head 10 need not be removed from its bore to repair a malfunctioning guide vane valve assembly.

Having briefly described the maneuvering impact boring head 10 according to the present invention, as well as some of its more significant features and advantages, the boring head 10 and its associated apparatus will now be described in detail. Referring back now to FIGS. 1 and 2, the maneuvering impact boring head 10 may comprise a main body 12 having a conical nose section 22 and a cylindrical body section 24. A plurality of guide vanes or fins may be attached to the body 12 to stabilize the boring head 10 as it moves underground and to provide the boring head 10 with the ability to maneuver. In one preferred embodiment, a pair of fixed guide vanes 14 and 16 having a generally triangular shape are mounted to the cylindrical section 24 in substantially diametrically opposed relation. A pair of moveable guide vanes 18 and 20 are also mounted to the cylindrical section 24 at positions aft of, and generally aligned with, the respective fixed guide vanes 14 and 16. As will be described in greater detail below, each moveable guide vane 18, 20 is connected to a suitable actuator, such as guide vane actuator 62 (FIGS. 5 and 6), so that the guide vanes 18, 20 can be independently pivoted about axis 60 to provide a turning or yaw force to the boring head 10 and to provide a rolling force to the boring head 10.

Referring now to FIG. 2, the main body 12 contains an internal bore or cavity 28 having a front end 30 and a rear end 32. The internal bore or cavity 28 is adapted to slidably receive the striker 34. The cylindrical section 24 of body 12 also includes a plurality of cylinders, such as cylinders 68 and 70, that comprise the guide vane actuators, such as guide vane actuator 62. See FIGS. 2, 5, and 6. The cylindrical nose section 22 may also include a replaceable tip 26 that may be attached by any convenient means, such as by screw threads. The maneuvering impact boring head 10 may also comprise a bellows assembly 98 connected to the rear end 32 of body 12 to protect the hoses 52, 72, and 74 from abrasion. Alternatively, the bellows assembly 98 may be replaced with any of a wide range of protection/tether systems currently available for use with self-advancing boring heads, as would be obvious to persons having ordinary skill in the art.

Ideally, the main body 12 should be made as short as possible to provide a reasonably small turning radius while still providing adequate length to allow the striker 34 to be accelerated to a velocity sufficient to impart a substantial forward momentum to the main body 12. In one preferred embodiment, the overall length 11 of the main body 12 is about 12 inches, and the length of the internal cavity, i.e., the distance between the front end 30 and the rear end 32 is about 8 inches. The length of the internal cavity 28 is sufficient to allow the striker 34 to be accelerated to a velocity in the range of about 300 to 400 inches per second by the time it impacts the front end 30 of internal cavity 28.

The main body 12 may be fabricated from any of a wide range of materials suitable for the intended boring application. However, to ensure good boring performance, the mass of the main body 12 should be as small as possible so as not to absorb a substantial amount of the forward momentum from the striker 34. In one preferred embodiment, the main body 12 is fabricated from an aluminum alloy, although other materials could also be used without departing from the scope of the invention. Similarly, the guide vanes should also be as light as possible, again with the purpose of reducing the overall mass of the main body 12. However, since the guide vanes may be subject to considerable abrasive action from the soil through which the boring head is to be advanced, it may be necessary or desirable to choose a material for the guide vanes that will provide good abrasion resistance. For example, in one preferred embodiment, the guide vanes 14, 16, 18, and 20 are made from stainless steel.

Still referring to FIG. 2, the striker 34 may comprise a cylinder-cone-cylinder configuration having a cylindrically shaped head end 36 with a conical flare to a cylindrically shaped main body section. However, the overall shape of the striker 34 is not particularly critical and any of a wide variety of shapes may be used without departing from the scope of the invention. Striker 34 also includes a pair of seals 78 to provide a substantially gas tight fit between the striker 34 and the internal cavity 28. In one preferred embodiment, the seals 78 comprise conventional ring-type seals fabricated from Teflon®, although other kinds of seals materials could also be used, as would be obvious to persons having ordinary skill in the art. To increase boring efficiency, the striker 34 should be made from a relatively dense and heavy material that is capable of withstanding repeated high speed impacts with the front end 30 of cavity 28. In one preferred embodiment, the striker 34 is made from stainless steel, although other materials could also be used.

As was described above, the force required to return the striker 34 to the aft position 35 is provided by a compressed gas (not shown) contained within the chamber 56 defined between the front end 30 of cavity 28 and the striker 34. While nearly any type of compressible fluid may be used, it is preferred, but not required, that the compressible fluid comprise a substantially non-reactive gas, such as nitrogen. The use of a substantially non-reactive gas will reduce the chance of igniting any hydraulic fluid that may leak past the seals 78 and into the chamber 56. Alternatively, any of the noble gases, such as helium, argon, etc., may be used as well. In most cases it will also be necessary to pre-pressurize the compressible gas contained within the chamber 56 to ensure that the compressed gas will return the striker 34 fully to the aft position 35. In one preferred embodiment, the gas used to return the striker 34 to the aft position 35 is nitrogen and it is pre-pressurized to a pressure of about 60 psig with the striker 34 located in the aft position 35.

The chamber 56 may be filled with the compressible gas (e.g., nitrogen) via a suitable passageway (not shown) provided in the main body 12 and fluidically connecting the chamber 56 to one of the external surfaces of main body 12 (e.g., the rear end 32). A valve, such as a schrader valve (also not shown), may be provided at the external opening of the passageway to facilitate the filling of the chamber 56 with the compressible gas.

Figure 3:
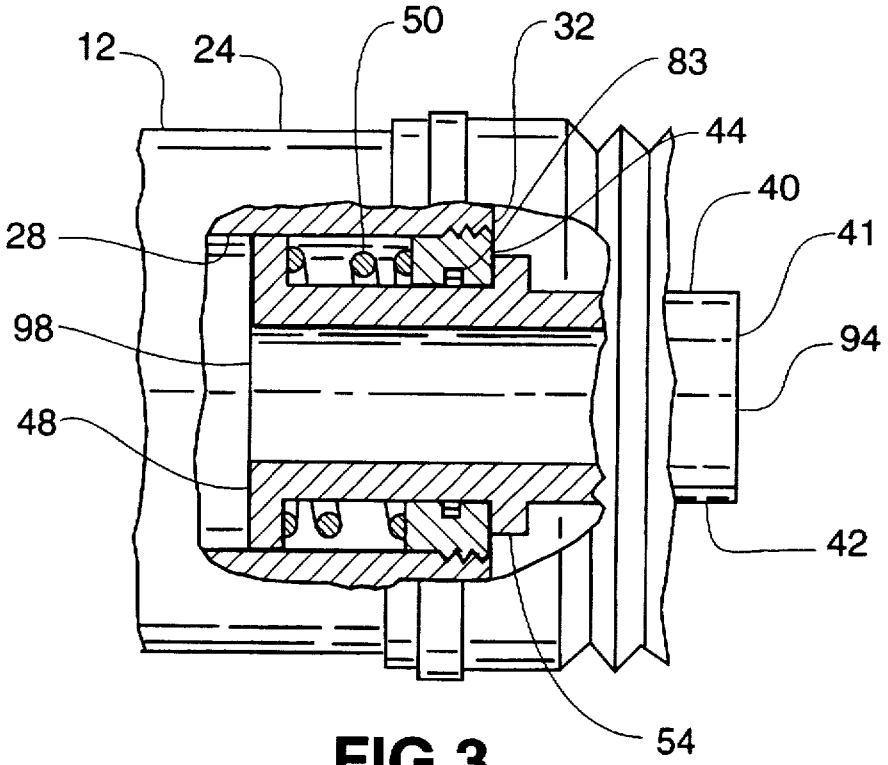
FIG. 3 is an enlarged cross-section view of the surge absorber in the normal position.

The surge absorber 40 is best seen in FIGS. 3 and 4 and comprises an elongate tubular coupling 42 that is slidably retained by an end cap 44. End cap 44 may be secured to the rear end 32 of main body 12 by any convenient means, such as by screw threads. The inlet end 94 of tubular coupling 42 is adapted to receive a fitting 96 attached to the end of hose 52. See FIG. 2. Tubular coupling 42 is biased toward the front end 30 of internal cavity 28 (FIG. 2) by a spring 50 positioned between shoulder 48 of coupling 42 and the end cap 44. Another shoulder 54 on coupling 42 acts as a stop to prevent the spring 50 from drawing the entire coupling 42 into the cavity 28. The spring 50 thus allows the coupling 42 to move between a forward position 41 shown in FIG. 3 and an aft position 41' shown in FIG. 4 (i.e., in the direction of arrow 46 shown in FIG. 2) to accommodate contractions in the hose 52 (FIG. 2) resulting from its pressurization. A seal, such as O-ring seal 83, mounted to end cap 44 prevents hydraulic fluid (not shown) from leaking past coupling 42.

The moveable guide vanes 18 and 20 may be pivoted about axis 60 (FIG. 1) by identical guide vane actuator assemblies. Referring now to FIGS. 5 and 6, a guide vane actuator assembly 62 for actuating the moveable guide vane 20 may comprise first and second cylindrical bores 68 and 70 within which are disposed respective pistons 64 and 66. Each piston 64, 66 abuts against bellcrank member 76 of guide vane 20. Each cylindrical bore 68, 70 is connected to a respective guide vane valve assembly 90, 92 (FIGS. 7 and 8) via flexible hoses 72, 74. Moveable guide vane 20 may be moved from a neutral position 21 shown in FIG. 5 to a deflected position 21' shown in FIG. 6 by applying hydraulic pressure to cylindrical bore 68 and relieving hydraulic pressure from bore 70. Of course, the guide vane 20 can be deflected in the opposite direction by reversing the hydraulic pressure, i.e., by pressurizing cylinder 70 and relieving the pressure in cylinder 68.

The hydraulic control system 58 for controlling the striker 34 and moveable guide vanes 18, 20 is best seen in FIG. 7. Hydraulic fluid (not shown) may be drawn from a reservoir 13 by a pump assembly 15 driven by a suitable motor 17. A filter assembly 19 may be included between the reservoir 13 and pump 15 to remove any particulate matter from the hydraulic fluid (not shown). A pressure relief valve 23 connected to the outlet 69 of pump 15 opens if the hydraulic pressure exceeds a predetermined pressure. In one preferred embodiment, pressure relief valve 23 opens if the hydraulic pressure exceeds about 2600 psig. A pressure gauge assembly 25 may also be connected to the outlet 69 of pump 15 to allow the user (not shown) to monitor the system pressure. The outlet 69 of pump 15 is connected to a main supply line 27 via a check valve 29. An accumulator 31 connected to main supply line 27 serves as the primary source of pressurized hydraulic fluid for the various valve assemblies 88, 90, and 92. A pressure gauge assembly 33 mounted to the main supply line 27 allows the user to monitor the pressure in main supply line 27. A pressure transducer 39 may also be mounted to the main supply line 27 for converting the pressure in main line 27 into an electronic signal suitable for use by the computer system 80. A bleed valve 37 connected between main supply line 27 and reservoir 13 provides a convenient means to relieve the pressure in the main supply line 27 and/or drain the system for maintenance.

A pressure regulator 51 connected between the main supply line 27 and a low pressure main line 49 reduces the relatively high pressure (e.g., 2500 psig) hydraulic fluid in the main line 27 to a lower pressure of about 300 psig, which is sufficient to operate the guide vane valve assemblies 90 and 92. Low pressure main line 49 may also be equipped with a pressure transducer 53 and a pressure gauge assembly 55 to allow the pressure in the low pressure main line 49 to be monitored by the computer system 80 or visually by the user, as the case may be.

The striker valve assembly 88 comprises a main valve 43 and a hydraulic piston pump 45. Main valve 43 is connected between the main supply line 27 and the input side 75 of hydraulic piston pump 45. The output side end 77 of hydraulic piston pump 45 is connected to hose 52. The main valve 43 cyclically reverses the hydraulic pressure on the input end 75 of the hydraulic piston pump 45 which causes the piston 71 to reciprocate in the directions indicated by arrows 73. The reciprocating piston 71 produces a corresponding cyclical variation in the hydraulic pressure in hose 52. A position trim valve assembly 47 connected between the low pressure main line 49 and the input end 75 of piston pump 45 may be used to fine tune the position of piston 71, thus the position of the striker 34 within the internal cavity 28 (FIG. 2). Hydraulic piston pump 45 may also include a position transducer 67 for producing an output signal relating to the position of the piston 71 that is suitable for use by the computer system 80.

In one preferred embodiment, the main valve 43 is cycled at a rate in the range of about 50 to 200 cycles per minute which, of course, will cause the striker 34 to reciprocate at essentially the same rate. In one preferred embodiment, the hydraulic piston pump 45 is a "one-to-one" pump and does not increase the hydraulic pressure. Thus, the pressure at the output end 77 of the hydraulic piston pump 45 is essentially identical to the pressure in the main supply line 27 (e.g., 2500 psi), which is sufficient to drive the striker 34 to the forward position 35' (FIG. 2) at velocities in the range of about 300 to 400 inches per second. Alternatively, if higher pressures are desired to reciprocate the striker 34, the hydraulic piston pump 45 could be modified to function as a hydraulic intensifier. Such a hydraulic intensifier would essentially be identical to the hydraulic piston pump 45, except that the size (i.e., area) of the piston in the output end 77 would be smaller than that of the piston in the input end 75, as best seen in FIG. 7.

Each guide vane actuator (e.g., guide vane actuator 62) (FIGS. 5 and 6) may be operated independently of the other by guide vane valve assemblies 90 and 92. As was the case for each guide vane actuator, each guide vane valve assembly 90, 92 is identical. Therefore, only guide vane valve assembly 92 will be described in detail. Essentially, guide vane valve assembly 92 comprises a valve 57 connected between the low pressure main line 49 and hoses 72, 74. A dual counter balance 79 connected between valve 57 and the guide vane actuator 62 contained in the boring head 10 (FIGS. 5 and 6) prevents the guide vane 20 from moving against the hydraulic pressure in line 49. A position sensor 59 connected between dual counter balance and in series with hose 72 provides a guide vane position signal for the computer system 80 that is indicative of the position of the guide vane 20.

In operation, guide vane valve assembly 92 selectively pressurizes and de-pressurizes (i.e., vents) the hoses 72, 74, causing the pistons 64, 66 to reciprocate in their respective bores 68, 70 (FIG. 5). The reciprocating pistons 64, 66 cause the guide vane 20 to pivot about axis 60 in the manner already described.

The hydraulic control system 58 may be operated by any of a wide range of devices well-known in the art for controlling the various valves associated with the hydraulic system 58. For example, the hydraulic control system 58 could be operated by an electronic control system specifically designed to operate the various valves and in the various sequences required to operate the boring head according to a predetermined schedule. Alternatively, the hydraulic control system 58 could be operated by a programmable control system comprising a general purpose computer programmed to operate the hydraulic control system 58 according to the desired schedule. Such a general purpose programmable system has the advantage of flexibility in selecting and programming specific operating modes and, of course, may be used in conjunction with more than one type of hydraulic control system. In any event, the selection of the particular electronic control system for operating the hydraulic control system 58 would be obvious to persons having ordinary skill in the art after having become familiar with the teaching of this invention and after considering the requirements of the desired application. Consequently, the present invention should not be regarded as limited to one any particular type system for controlling the operation of the hydraulic system 58.

However, in the interest of providing a background for appreciating some of the features that such a control system might have, a general purpose PC-based computer control system 80 is shown in FIG. 8 and generally described below. It should be noted however, that the following description of the computer system 80 does not include details of many components, such as relays, switches, surge suppressors, analog-to-digital converters, etc., that would be generic to such a computer control system or that may be required for a specific application. Since systems for controlling hydraulic systems, such as hydraulic system 58, have existed for decades and are well known, it would be obvious to persons having ordinary skill in the art to add to the system shown and described herein any such components that may be necessary or desirable for a specific installation.

Referring now to FIG. 8, a PC-based computer control system 80 may comprise a personal computer 82 to which may be connected a suitable display device, such as a CRT 61, a keyboard 63, and a pointer device, such as a mouse 65. A cylinder control module 84 may be connected to the PC 82 by any convenient means, such as via a parallel or serial data port (not shown). The cylinder control module 84 receives data signals from PC 82 and may optionally receive position signals from the various valve assemblies 88, 90, and 92. For example, the striker valve assembly 88 may provide a signal from the position transducer 67 that is indicative of the position of the cylinder 71 of hydraulic piston pump 45 which, of course, is related to the position of the striker 34 within cavity 28 (FIG. 2). Similarly, guide vane valve assemblies 90 and 92 may provide signals from the position sensors (such as sensor 59) which is indicative of the position of the guide vanes 18 and 20. Cylinder control module 84 may also receive pressure signals from the pressure transducers 39 and 53, thus allowing the computer system 80 to monitor the pressure in the main supply line 27 and low pressure supply line 49.

A valve control module 86 connected to the cylinder control module 84 receives control signals from the cylinder control module 84 and converts them into a form suitable for operating the various valves, such as valves 43, 47, and 57 that comprise the hydraulic system 58.

Depending of the particular application in which the maneuvering impact boring head 10 is to be used, it may be desired, but not required, to provide the maneuvering impact boring head 10 with a plurality of attitude sensors, such as gyroscopes (not shown). Such sensors could be connected to the PC 82 via a suitable cable assembly 81 to allow the position of the boring head 10 to be monitored and accurately determined at all times during the boring operation. Such attitude sensors would also allow for more accurate maneuvering of the boring head 10.

This completes the detailed description of the various embodiments of the maneuvering impact boring head 10 according to the present invention. While a number of specific components were described above for the preferred embodiments of this invention, persons having ordinary skill in the art will readily recognize that other substitute components or combinations of components may be available now or in the future to accomplish comparable functions to the various components shown and described herein. For example, the specific shape of the main body 12 of the boring head 10 is not particularly critical, and boring heads falling within the scope of the present invention could have a variety of shapes depending on the desired application or on the particular fabrication techniques that will be used to manufacture the boring head. Similarly, the various components of the boring head 10 could be made from materials other than aluminum and stainless steel.

Still other modifications are possible. For example, while one type of hydraulic control system 58 was shown and described herein for controlling the operation of the boring head, hydraulic systems having other components or other configurations could be used so long as they are capable of driving the striker 34 with sufficient velocity to accomplish boring and, of course allowing the compressed gas contained within the chamber 56 to return the striker 34 to the aft position. As was also mentioned above, other types of electronic control systems may be used to operate the hydraulic control system 54 and the selection and provision of a particular electronic control circuit would be obvious to persons having ordinary skill in the art after having become familiar with the teachings of the present invention. Of course, the maneuvering boring head could also be adapted to be operated with compressed air (i.e., pneumatic powered) instead of with pressurized hydraulic fluid.

In sum, then, it is contemplated that the inventive concepts herein described may be variously otherwise embodied and it is intended that the appended claims be construed to include alternative embodiments of the invention except insofar as limited by the prior art.

What is claimed is:

1. An impact boring system, comprising:

a main body having an internal cavity with a front end and a rear end, said main body having a fixed guide vane mounted to said main body and moveable guide vane mounted to said main body aft of said fixed vane;

a striker having a head end and a tail end slidably mounted in the internal cavity of said main body so that said striker can be reciprocated in the internal cavity between a forward position and an aft position;

a compressible gas contained within the sealed internal cavity between the head end of said striker and the front end of the internal cavity; and pressurized fluid delivery means fluidically connected to said main body for introducing a fluid under pressure to the rear end of the sealed internal cavity of said main body, the fluid under pressure acting against the tail end of said striker to drive said striker to the forward position, wherein forward momentum from said striker is transferred to said main body when said striker reaches the forward position and wherein said striker pressurizes said compressible gas as said striker moves from the aft position to the forward position, the pressurized compressible gas returning said striker to the aft position upon removal of the fluid under pressure from the tail end of said striker.

2. The impact boring system of claim 1, wherein the head end of said striker contacts the front end of the internal cavity in said main body when said striker is in the forward position.

3. The impact boring system of claim 2, wherein said main body comprises a conically shaped nose section and a cylindrically shaped body section.

4. The impact boring system of claim 1, wherein said fixed guide vane and said moveable guide vane are mounted to said cylindrically shaped body section.

5. The impact boring system of claim 1, further comprising guide vane actuator means connected to said moveable guide vane for pivotally moving said moveable guide vane about a guide vane pivot axis.

6. The impact boring system of claim 5, wherein said guide vane pivot axis is transverse to a longitudinal axis of said main body.

7. The impact boring system of claim 1, wherein said pressurized fluid delivery means comprises:

a reservoir containing a supply of a fluid;

a pump connected to said reservoir for increasing the pressure of the fluid to a first pressure;

a valve connected to said pump;

flexible conduit means connected to said valve and to said main body for fluidically connecting the rear end of the internal cavity of said main body to said valve; and valve control means operatively associated with said valve for controlling a flow of pressurized fluid from said pump through said flexible conduit means, wherein actuation of said valve control means causes said striker to move between the aft position and the forward position.

8. The impact boring system of claim 7, further comprising surge absorber means mounted to the main body and adapted to receive said flexible conduit means for absorbing contractions of said flexible conduit means.

9. The impact boring system of claim 8, wherein said surge absorber means comprises:

an elongate tubular coupling having a first end and a second end, the first end being adapted to receive said flexible conduit means;

an end cap mounted to the rear end of the internal cavity, said end cap having a central aperture adapted to slidably receive said elongate tubular coupling;

biasing means operatively associated with said elongate tubular coupling for biasing said elongate tubular coupling toward the front end of the internal cavity.

10. The impact boring system of claim 9, wherein the second end of said elongate tubular coupling includes a shoulder and wherein said biasing means includes a spring positioned between the shoulder and said end cap.

11. The impact boring system of claim 7, further comprising pressure intensifier means fluidically connected between said valve and said flexible conduit means for increasing the pressure of the pressurized fluid from the first pressure to a second pressure.

12. The impact boring system of claim 7, wherein the fluid comprises hydraulic fluid.

13. The impact boring system of claim 7, wherein the fluid comprises air.

14. An impact boring head, comprising:

a main body having an internal cavity with a front end and a rear end, said main body having a fixed guide vane mounted to said main body and moveable guide vane mounted to said main body aft of said fixed vane;

a striker having a head end and a tail end slidably mounted in the internal cavity of said main body so that said striker can be reciprocated in the internal cavity between a forward position and an aft position; and a compressible gas contained in the internal cavity between the head end of the striker and the front end of the internal cavity.

15. The impact boring apparatus of claim 14, wherein the head end of said striker contacts with the front end of the internal cavity in said main body when said striker is in the forward position.

16. The impact boring apparatus of claim 15, wherein said main body comprises a conically shaped nose section and a cylindrically shaped body section.

17. The impact boring apparatus of claim 16, wherein said fixed guide vane and said moveable guide vane are mounted to said cylindrically shaped body section.

18. The impact boring apparatus of claim 17, further comprising guide vane actuator means connected to said moveable guide vane for pivotally moving said moveable guide vane about a guide vane pivot axis.

19. The impact boring apparatus of claim 14, further comprising surge absorber means mounted to the main body and adapted to receive a flexible conduit for absorbing contractions of the flexible conduit.

20. The impact boring apparatus of claim 19, wherein said surge absorber means comprises:

an elongate tubular coupling having a first end and a second end, the first end being adapted to receive the flexible conduit;

an end cap mounted to the rear end of the internal cavity, said end cap having a central aperture adapted to slidably receive said elongate tubular coupling;

biasing means operatively associated with said elongate tubular coupling for biasing said elongate tubular coupling toward the front end of the internal cavity.

21. The impact boring apparatus of claim 20, wherein the second end of said elongate tubular coupling includes a shoulder and wherein said biasing means includes a spring positioned between the shoulder and said end cap.

22. An impact boring apparatus, comprising:

a main body having an internal cavity with a front end and a rear end, said main body having a fixed guide vane mounted to said main body and moveable guide vane mounted to said main body aft of said fixed vane;

a striker having a head end and a tail end slidably mounted in the internal cavity of said main body so that said striker can be reciprocated in the internal cavity between a forward position and an aft position;

a compressible gas contained in the internal cavity between the head end of the striker and the front end of the internal cavity;

a reservoir containing a supply of a fluid;

a pump connected to said reservoir for increasing the pressure of the fluid to a first pressure;

a valve connected to said pump;

flexible conduit means mounted connected to said valve and to said main body for fluidically connecting the rear end of the internal cavity of said main body to said valve;

surge absorber means mounted to the main body and adapted to receive said flexible conduit means for absorbing contractions of said flexible conduit means; and valve control means operatively associated with said valve for controlling a flow of pressurized fluid from said pump through said flexible conduit means, the flow of pressurized fluid acting against the tail end of said striker to drive said striker to the forward position, wherein forward momentum from said striker is transferred to said main body when said striker reaches the forward position and wherein said striker pressurizes said compressible gas as said striker moves from the aft position to the forward position, the pressurized compressible gas acting to return said striker to the aft position upon removal of the flow of pressurized fluid from the tail end of said striker.

* * * * *